US006474493B1

(12) United States Patent
Lacout

(10) Patent No.: US 6,474,493 B1
(45) Date of Patent: Nov. 5, 2002

(54) ASSEMBLY ARTICULATED BY A HINGE WITH ASSISTED OPENING/CLOSING

(75) Inventor: Frank Lacout, Draveil (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/441,059

(22) Filed: Nov. 16, 1999

(30) Foreign Application Priority Data

Nov. 16, 1998 (FR) ..... 98-14354

(51) Int. Cl.[7] ..... B65D 6/28

(52) U.S. Cl. ..... 220/4.22; 220/264; 220/847; 200/459.1

(58) Field of Search ..... 220/847, 4.22, 220/4.33, 264, 283

(56) References Cited

U.S. PATENT DOCUMENTS

| | | | | | |
|---|---|---|---|---|---|
| 1,950,195 | A | * | 3/1934 | Scandong | 229/125.11 |
| 2,195,593 | A | | 4/1940 | Kreisler | |
| 2,467,545 | A | * | 4/1949 | Young | 220/847 |
| 2,490,740 | A | * | 12/1949 | Carpenter, Jr. | 220/829 |
| 2,638,253 | A | | 5/1953 | Mueller | |
| 2,742,665 | A | * | 4/1956 | Szopek | 220/829 |
| 3,048,320 | A | * | 8/1962 | Hovland et al. | 229/188.11 |
| 3,289,877 | A | | 12/1966 | Wolf | |
| 3,362,591 | A | | 1/1968 | Latham et al. | |
| 3,442,415 | A | * | 5/1969 | Glass | 220/847 |
| 3,477,091 | A | * | 11/1969 | Gordon | 220/829 |
| 3,541,730 | A | * | 11/1970 | Ballantyne | 220/827 |
| 3,741,447 | A | | 6/1973 | Miles et al. | |
| 3,923,180 | A | | 12/1975 | Fields | |
| 3,968,880 | A | | 7/1976 | Ostrowsky | |
| 4,043,480 | A | * | 8/1977 | Savoy | 220/829 |
| 4,124,151 | A | | 11/1978 | Hazard | |
| 4,158,902 | A | | 6/1979 | Chernack et al. | |
| 4,401,229 | A | * | 8/1983 | Bell et al. | 220/847 |
| 4,452,373 | A | * | 6/1984 | Pearce et al. | 220/829 |
| 4,813,560 | A | | 3/1989 | Begley | |
| 4,890,742 | A | | 1/1990 | Allison | |
| 5,040,680 | A | * | 8/1991 | Wilson et al. | 220/847 |
| 5,501,348 | A | * | 3/1996 | Takeuchi | 220/827 |
| 5,784,749 | A | | 7/1998 | Garbacik, Jr. et al. | |

FOREIGN PATENT DOCUMENTS

| | | |
|---|---|---|
| EP | 0 699 591 B1 | 3/1996 |
| EP | 0 727 361 | 8/1996 |
| EP | 0 873 944 | 10/1998 |
| FR | 2 599 715 | 12/1987 |

* cited by examiner

*Primary Examiner*—Joseph M. Moy
(74) *Attorney, Agent, or Firm*—Oblon, Spivak, McClelland, Maier & Neustadt, P.C.

(57) ABSTRACT

An assembly includes a first part and a second part articulated to the first part. A label is bonded onto at least a portion of the surface of each of the first and second parts. The label has at least one connecting strip capable, when the assembly is being opened and being closed, of occupying an intermediate position in which it intersects a geometric axis about which the assembly is hinged. The label experiences maximum tension and, after passing through the intermediate position by a relative movement of the first and second parts in a first direction, elastically returns the second part to a closed or almost closed position. After passing through the intermediate position in a direction which is the opposite of the first direction, the label elastically returns the second part to an opened position.

42 Claims, 4 Drawing Sheets

ASSEMBLY ARTICULATED BY A HINGE WITH ASSISTED OPENING/CLOSING

BACKGROUND OF THE INVENTION

1. Field of the Invention

The present invention relates to an assembly comprising two parts hinged together by a hinge with assisted opening/closing. An assembly of this kind may, in particular, be formed of a stoppering element comprising a body to which a closure cap is hinged. Alternatively, it may be a container comprising a lid hinged to a bottom. A container of this type may be in the form of a case of the make-up type, or of a pot, or in any other form of container which can be closed by a hinged lid.

2. Description of the Related Art

It is known practice, particularly in the case of stoppering elements, for such assemblies to be made in two parts hinged together and obtained by one-piece moulding from materials such as polyethylenes or polypropylenes. The two parts can be folded about a main geometric axis and are connected by film hinges with at least one intermediate element arranged between them. The intermediate element is capable of forming a spring so that, after it has passed through a position of unstable equilibrium, it returns the cap of the stoppering element to the closed or almost closed position, or to the opened position. Such systems, although in widespread use, do have certain drawbacks associated with the complexity and cost of the mold needed to produce them in a single piece. Furthermore, producing these elements as a single piece and therefore generally from one single material makes it necessary to come to a compromise between the properties sought for the stoppering element itself and the properties required of the intermediate element capable of forming the return spring. The result of this compromise is generally that the material is not the optimum material for fulfilling the intermediate-element function. It is therefore frequently found that such hinges experience an appreciable loss of elasticity after they have been used a few times.

However, such one-piece structures are generally considered to operate satisfactorily in the case of caps of the type used for stoppering bottles, particularly of cosmetic products. These caps are semi-rigid, i.e. they have a certain elasticity. In general, the elastic deformability of the two parts connected by the hinge is used to encourage the hinge to act as a spring. However, the use of such hinges becomes more difficult when two rigid pieces, which have appreciably no flexibility or elasticity, have to be hinged together. This is the scenario, in particular, where cases of the make-up type or pots of the cosmetic type are concerned. The constituent parts of such elements may have a mean thickness which may be of the order of a few millimeters and which prevents practically any elastic deformability of the parts adjacent to the hinge. In the case of a cosmetic pot, the lid is generally screw-fastened onto the pot with all the drawbacks associated therewith. With cases where elasticity for opening and/or closing is desired, use is made of auxiliary spring mechanisms which have a substantial impact on the cost price of such cases. Furthermore, the presence of these attached mechanisms is a source of weakness for the case.

Such cases or pots may further comprise a label intended to form a decoration or a support for information, particularly of a technical or commercial nature relating to the product contained therein or to the company marketing them. Depending on the desired decoration or on the amount of information to be printed, it may sometimes be desirable to have a label which extends over the surface of both of the hinged-together elements at the same time. With the conventional hinges used, particularly for cases or pots, it is sometimes difficult to produce such a label in a single piece. This difficulty occurs because that portion of the label which is to lie facing the hinge zone could have a significant effect on the operation of the hinge.

SUMMARY OF THE INVENTION

One of the objects of the present invention is to produce a structure with two elements hinged together by a hinge with assisted opening and closing. This structure completely or partially solves the problems discussed hereinabove with reference to the known devices.

A particular object is to produce such a hinge for elements having portions located on each side of the hinge axis with practically no elasticity or elastic deformability.

According to the invention, these objects are achieved by producing an assembly comprising a first part and a second part, said second part being hinged to the first part about an axis lying in a closure plane, and a sheet fixed onto at least a portion of the surface of each of the first and second parts, said sheet comprising at least one connecting strip which, when the assembly is in the closed position, intersects the closure plane without passing through the axis, said connecting strip being capable, at the opening and closing of the assembly, of occupying an intermediate position in which it intersects the axis, and in which it experiences maximum tension, said connecting strip being capable, after passing through the intermediate position by a relative movement of the first and second parts in a first direction, of elastically returning the second part to a closed or almost closed position and, after passing through the intermediate position in a direction which is the opposite of the first direction, of elastically returning the second part to an opened position.

Thus, by producing the elastic return element in the form of an attached sheet, it is possible to produce a hinge with assisted opening and closing between two rigid elements, such as the bottom and the lid of a case of the make-up type. The two hinged-together parts may be formed of two pieces which can be molded separately, which appreciably reduces their cost. The sheet may furthermore be sized so that it covers a substantial part of at least one of the parts of the assembly, so as to form a label, either for decorating the corresponding part(s) or for printing information, particularly of a technical or commercial nature. Thus, the spring function of the hinge is fulfilled by an element which at the same time acts as a decoration or as a support for information. When the label has to extend over a substantial portion of the surface of both parts of the assembly, it can be made as a single piece. In the case of certain applications, it may facilitate operations, particularly cutting and/or affixing operations.

According to a specific embodiment, the assembly comprises a connecting strip positioned between two hinge elements defining the axis and arranged one on each side of the connecting strip. According to an alternative, it comprises two connecting strips separated by a hinge element defining the axis. The choice between the embodiments depends to a large extent on the configuration and geometric shape of the two parts which form the assembly and also on the desired elasticity upon opening and closing.

The hinge element(s) may, in particular, consist of film hinges or of hinges with an attached axle, or of the type with an element borne by either the first or second parts, mounted so that it can rotate inside a recess formed in either the bottom or the lid.

The sheet may be made of a thermoplastic chosen, in particular, from polyethylenes, polypropylenes, polyethylene terephthalates and thermoplastic elastomers. This sheet may also be made using woven or nonwoven materials. The thickness of a sheet of this kind may range from a few tenths of a millimeter to one millimeter, or more. This thickness is chosen as a function of the desired elasticity and of the material used.

As a preference, the first and second parts are configured in such a way as to be rigid, particularly around the hinge axis. In other words, they cannot deform elastically to any appreciable extent during opening and closing.

By way of example, the assembly according to the invention forms a stoppering element, said first part forming a body intended to be a container, said body defining at least one opening of the container, said second part being formed of a cap capable of removably closing off the opening.

However, by way of a preferred example, the assembly according to the invention consists of a container, said first part constituting a bottom capable of containing a product and a free edge which defines an opening, said second part forming a lid capable of sealing the opening closed.

As a preference, the container comprises a device capable of allowing the lid to be locked reversibly onto the bottom in the closed position. Such devices are well known, particularly for closing cases, and may include clasps of the type with elastically deformable elements.

Advantageously, the container is produced in the form of a case of an almost flat shape with a bottom that defines at least one compartment for receiving a product, particularly in solid or pulverulent form. The product may, in particular, be a make-up product in pulverulent or compacted form. Such a case may also contain a mirror, advantageously arranged on the inside face of the lid, and an applicator, particularly in the form of a brush or of a puff arranged in a housing in the case which is provided for this purpose.

Alternatively, the container may be in the form of a pot with a wide opening. A pot of this type may be designed for packaging care products or medicinal products in the form of tablets.

As a preference, the sheet covers a substantial part of at least one of the parts. The sheet forms a decoration or a support for information particularly of the logo or trademark type, or of a commercial or technical nature. Such a label is bonded on in the conventional way over its entire surface. It may, in particular, be self-adhesive. However, for reasons of comfort, it may be advantageous to envision the sheet not to be adhesive on its surface which is intended to form the connecting strip. The decoration or information is printed onto the label-forming sheet by any appropriate printing technique, particularly by screen printing. Such printing techniques are well known and therefore require no further detailed description.

BRIEF DESCRIPTION OF THE DRAWINGS

Apart from the provisions explained hereinabove, the invention consists of a certain number of other provisions which will be explained hereinbelow with regard to non-limiting embodiments described with reference to the appended figures, in which.

DETAILED DESCRIPTION OF THE INVENTION

Figure 1B:
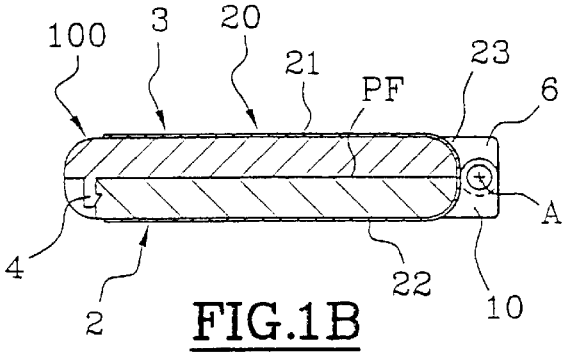
FIGS. 1A–1C depict a first embodiment of an assembly according to the invention in the form of a case of the make-up type.
Figure 1C:
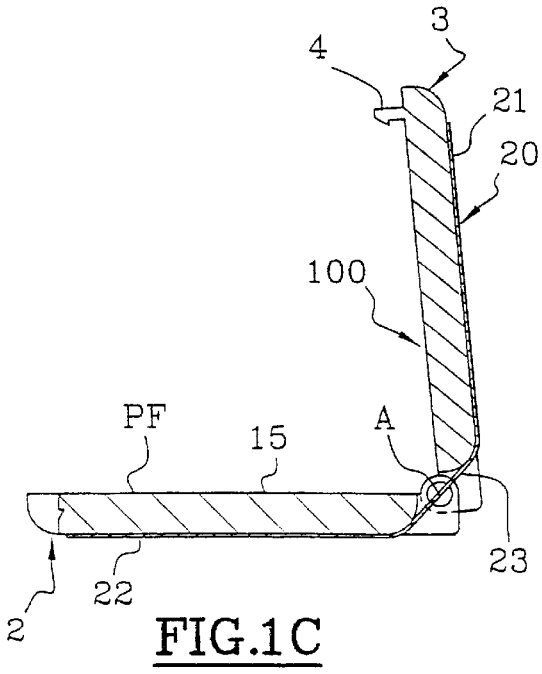
Figure 1A:
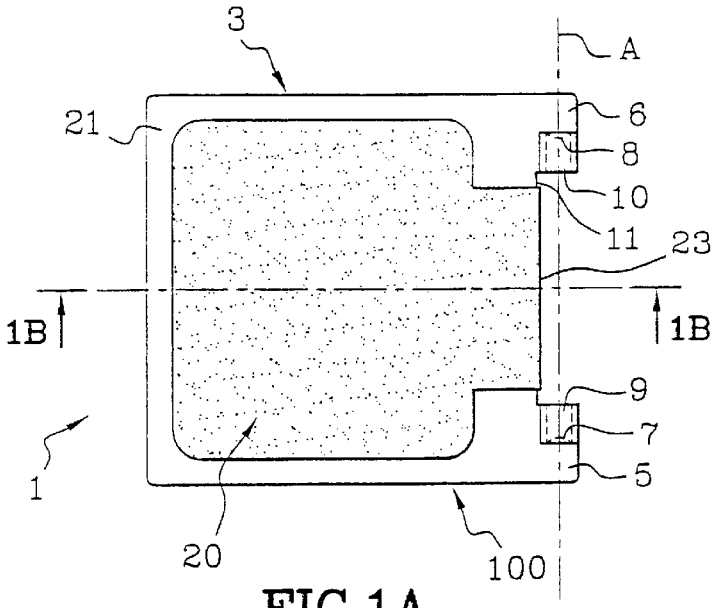

As depicted in FIGS. 1A–1C to which reference is now made, the assembly 1 according to the invention is in the form of a case 100 of roughly square cross section and approximately flat shape, i.e. where thickness is its shortest dimension. The case 100 comprises a flat bottom 2 and a flat lid 3 hinged to the bottom 2 about a geometric axis A. The bottom 2 forms a recess 15 intended to contain a make-up product in the form of a compacted powder. A clasp 4 is provided on the side opposite to the geometric axis A so as to lock the lid 3 reversibly onto the bottom 2 in the positions illustrated in FIG. 1A. In this closed position, the lid 3 is closed down onto the bottom 2 at a closure plane PF. The closure plane PF contains the axis A.

On the face opposite the clasp 4, the lid has two arms 5 and 6, the free ends of which are turned to face each other and end in protrusions 7, 8 capable of engaging with a corresponding depression made in the free ends of two arms 9, 10 borne by the bottom 2 of the case 100. The arms 5, 6 of the lid 3 are brought into engagement with the arms 9, 10 of the bottom 2 by a slight elastic deformation of all arms, so as to force the protrusions 7, 8 into the corresponding depressions in the bottom 2, thus defining a hinging of the lid 3 to the bottom 2 about the geometric axis A. As it is clearly apparent in FIG. 1A, an edge 11 of the case 100 on the side opposite to the clasp 4 is set back from the axis A in its central portion by a distance which may be of the order of one millemeter.

A self-adhesive polyethylene sheet or label 20 is bonded onto the case 100 and covers most of the two main faces 21, 22 thereof. The face 21 bears a commercial logo. The face 22 bears information about the main constituents of the product contained in the case 100. The label, 0.2 mm thick, is made as a single piece and has a central connecting strip 23 lying facing the edge 11 of the case 100, extending over a width which corresponds roughly to the distance separating the arms 9 and 10 of the bottom 2 of the case 100. Over this strip 23 lying facing the edge 11, the label 20 is nonadhesive. As it is clearly apparent from FIGS. 1A and 1B, when the case is in the closed position, the connecting strip 23 intersects the closure plane PF and extends roughly in a plane parallel to the axis A but not containing the axis A. In this position, the connecting strip 23 lies inside the geometric axis A. In this position, the strip 23 is not appreciably taut.

To open the case 100, the user pivots the lid 3 with respect to the bottom 2 about the axis A. After pivoting through about 80°, as depicted in FIG. 1C, the connecting strip 23 passes through a position of maximum tension in which it extends in a plane containing the geometric axis A. The position of maximum tension may be obtained for an angle of pivoting smaller than 80°. In practice, this position may be obtained for an angle of about 45°. Once this position has been passed, the connecting strip 23, because of its elastic elongation properties, elastically returns the lid 3 to a wide-open position, in which the lid 3 is arranged, for example, at 180° with respect to the bottom 2. In this position, the axis A lies between the connecting strip 23 and the edge 11 of the case 100. The connecting strip 23 is again not appreciably taut. To close the case 100, the user performs the reverse operation by pivoting the lid 3 towards the bottom 2. In doing so, the connecting strip 23 passes back through a position of unstable equilibrium corresponding to the same angle as the angle of the position of unstable equilibrium for opening the case 100. In this position, the connecting strip 23 is tensioned to a maximum and lies in a plane containing the geometric axis A. Thereafter, by elastic return, the connecting strip 23 brings the lid 3 into a closed or almost closed position. The return force may be high enough to allow the lid 3 to snap lock onto the bottom automatically. Alternatively, it may be necessary to exert a slight pressure of the lid 3 onto the bottom 2, so as to allow the case 100 to be locked in the closed position.

Figure 2B:
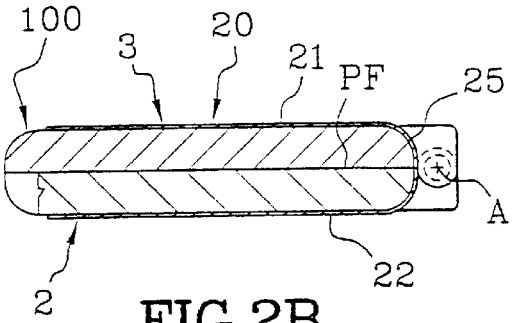
FIGS. 2A–2C illustrate an alternative form of the embodiment of FIGS. 1A–1C.
Figure 2C:
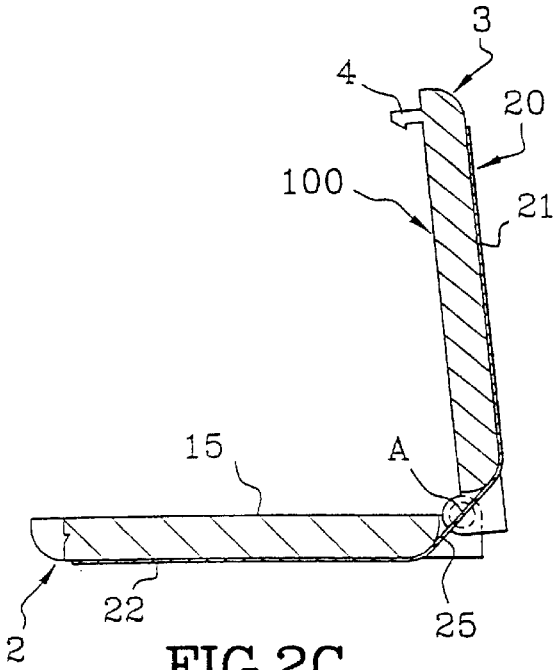
Figure 2A:
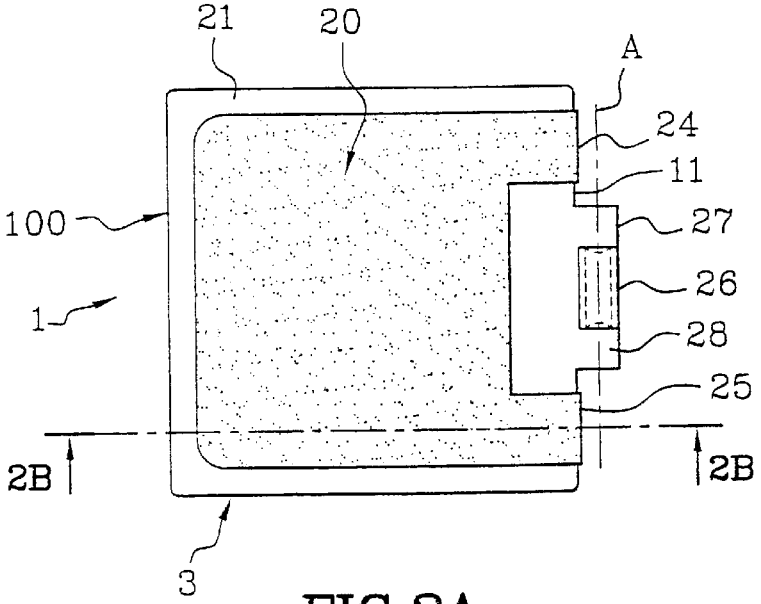

In the alternative form illustrated in FIGS. 2A–2C, the sheet or label 20 defines two lateral connecting strips 24,25 extending one on each side of the hinge of the case 100 about the geometric axis A. The lateral connecting strips 24, 25 each extend over a width of about 1 cm, for a case having a width, in the direction of the axis A, in the order of 5 cm. In this alternative form, a central portion 26 of the bottom 2 is mounted along the axis A so that it can rotate between two side portions 27, 28 of the lid 3. The way in which the assembly 1 operates, particularly for opening and closing, is identical to the way described with reference to FIGS. 1A–1C. The two lateral strips 24, 25 allow the lid 3 to be returned elastically to the opened or closed position during opening or closing, respectively and do so in the same way as the way employed in the previous embodiment, i.e. by passing through a position of unstable equilibrium in which they experience maximum tension. The remainder of the device is incidentally identical to what was described with reference to FIGS. 1A–1C.

Figure 3A:
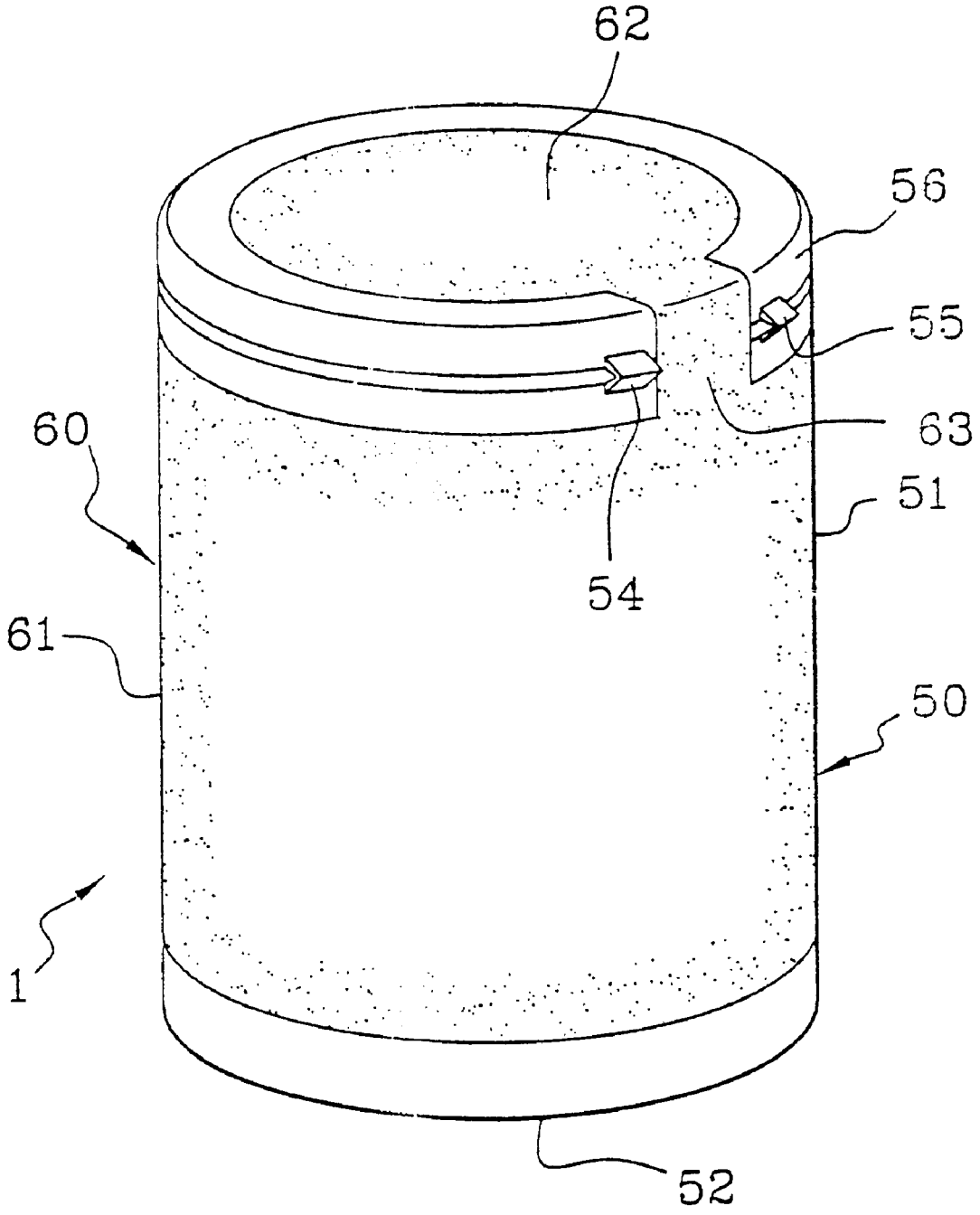
FIGS. 3A–3C illustrate a second embodiment of an assembly according to the invention in the form of a pot.
Figure 3B:
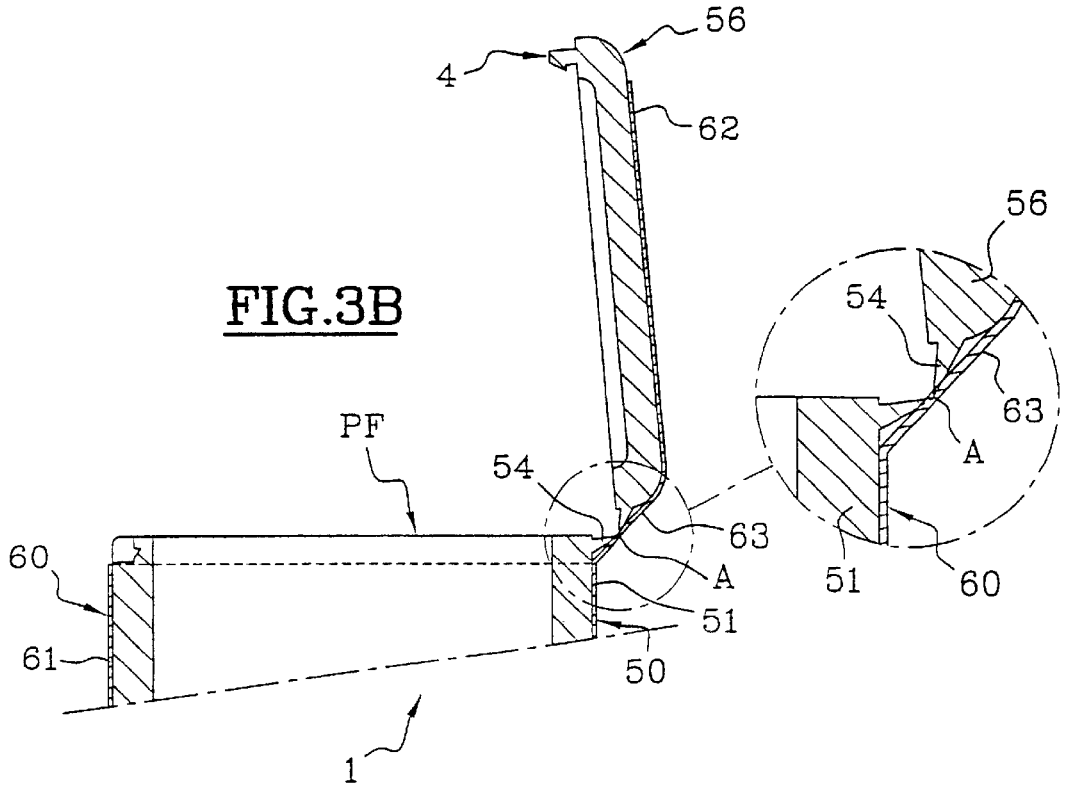
Figure 3C:
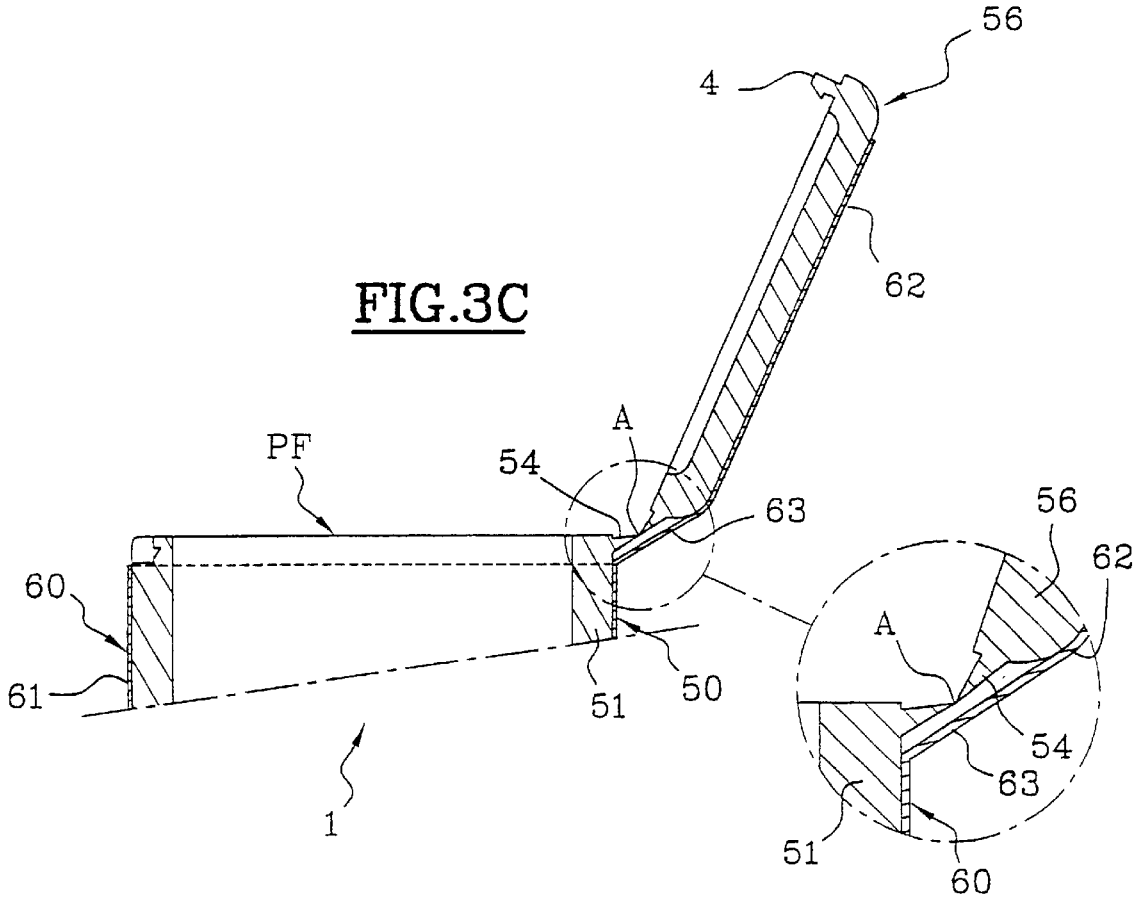

In the embodiment of FIGS. 3A–3C, the assembly 1 according to the invention consists of a pot 50, particularly made of polyvinyl chloride (PVC). The pot 50 has a body 51, one end of which is closed by a bottom 52, and the other end of which has a free end defining an opening arranged in a closure plane PF, seen only in FIG. 3B and 3C. A lid 56 is intended to close off the opening, removably. The lid 56 is hinged to the body 51 about the geometric axis A defined by two film hinges 54, 55 projecting slightly outwards from the external envelope of the pot 50. The clasp 4 allows the lid 56 to be locked reversibly onto the body 51. A self-adhesive polyethylene sheet or label 60 is bonded onto the pot 50. This label 60 consists of a first part 61 covering approximately three-fourths of the height of the body 51 of the pot 50, and of a second part 62 extending over a central portion of the exterior surface of the lid 56. The second part 62 bears the commercial logo of the company marketing the product contained in the pot 50. The first part 61 bears technical information relating to the product, and directions for the use of the product. The two parts 61 and 62 are connected by a connecting strip 63 extending over a width that is approximately equal to the distance separating the two film hinges 54 and 55 and which acts as a spring for the hinging between the body 51 and the lid 56. Typically, the width of the connecting strip 63 is of the order of five to seven millimeters. Each of the film hinges 54 and 55 extends over a width of about five mm. As a preference, the label 60 is nonadhesive over the strip 63. The way in which such a hinge works is illustrated in FIGS. 3B and 3C. In FIG. 3B, which corresponds to an angle of about 80° between the lid 56 and the top opening in the pot 50, the connecting strip 63 is in a position of maximum tension. In the same way as for the other embodiments, this position of unstable equilibrium may be obtained by a smaller angle of pivoting, i.e. by an angle of the order of about 45°, for example. Once this position of unstable equilibrium has been passed, the strip 63 by elastic return brings the lid 56 into the wide-open position depicted in FIG. 3C. Upon closure, the operation is identical. The material forming the label 60 is chosen so that it lengthens elastically by the amount needed to pass through the position of unstable equilibrium. For openings requiring a great deal of elongation, it may be desirable to make the label 60 out of elastomer, particularly thermoplastic elastomer, such as a polyethylene elastomer.

According to an alternative which has not been depicted, the geometric axis A is defined by a single film hinge 54 or 55, while elastic return is provided by two lateral connecting strips 63 arranged one on each side of the film hinge 54 or 55. The choice between the configurations depends to a large extent on the cross section of the pot 50.

In the foregoing detailed description, reference was made to preferred embodiments of the invention. It is clear that alternatives thereto may be sought without departing from the spirit of the invention as claimed hereinafter.

What is claimed is:

1. An assembly comprising:

a first part;

a second part hinged to the first part about a geometric axis lying in a closure plane; and a sheet adhesively bonded onto at least a portion of a surface of each of the first and second parts, wherein said sheet comprises at least one connecting strip which, when the assembly is in a closed position, intersects the closure plane without passing through the geometric axis, said connecting strip being configured to pass through an intermediate position at which the strip intersects the geometric axis and experiences maximum tension, and also being configured to elastically bring said first and second parts to an open position when said strip is on one side of said intermediate point and to elastically bring said first and second parts to an at least partially closed position when said strip is on another side of said intermediate point;

wherein said sheet is a film adhesively bonded to an outer surface of one of said first and second parts.

2. An assembly according to claim 1, wherein the connecting strip is positioned between two hinge elements defining the geometric axis.

3. An assembly according to claim 1, wherein the connecting strip comprises two parts separated by a single hinge element defining the geometric axis.

4. An assembly according to claim 1, wherein articulation about the geometric axis is achieved by one of film hinges, hinges with an attached axle, and hinges with an element borne by one of the first and second parts, mounted so that the element can rotate inside a recess formed in the other of the first and second parts.

5. An assembly according to claim 1, wherein the sheet is made of a thermoplastic chosen from polyethylenes, polypropylenes, polyethylene terephthalates and thermoplastic elastomers.

6. An assembly according to claim 1, wherein the first and second parts are rigid in the vicinity of the geometric axis.

7. An assembly according to claim 1, wherein the assembly is a container, said first part constitutes a receptacle capable of containing a product, said first part has a free edge which defines an opening in the container and the second part forms a lid capable of sealing the opening.

8. An assembly according to claim 7, wherein the container includes a clasp capable of allowing the lid to be locked releasibly over the opening in the container.

9. An assembly according to claim 8, wherein the container is a case of almost flat shape and having a bottom defining at least one compartment for receiving said product.

10. An assembly according to claim 8, wherein the container is in the form of a pot.

11. An assembly according to claim 1, wherein the sheet is a label that covers a substantial part of at least one of the first and second parts, and forms one of a decoration and a support for one of a logo, a trademark, commercial information, and technical information.

12. An assembly according to claim 1, wherein the sheet is a label that has an adhesive over its entire surface with the exception of a part which corresponds to the connecting strip.

13. An assembly according to claim 1, wherein the sheet is a label made of one of a woven material and a nonwoven material.

14. An assembly according to claim 1, wherein the assembly forms a stoppering element, said first part forming a body mounted on a container, said body defining at least one outlet passage communicating with an opening in the container, and said second part being formed of a cap capable of removably closing off the outlet passage.

15. An assembly comprising:

a first part;

a second part;

a hinge connecting the first part and the second part for pivoting about a geometric axis lying in a closure plane; and a sheet adhesively bonded onto at least a portion of a surface of each of the first and second parts, said sheet having at least one connecting strip which crosses said geometric axis and experiences a maximum tension when the assembly moves between a closed position and an opened position;

wherein said sheet is a film adhesively bonded to an outer surface of one of said first and second parts.

16. Assembly according to claim 15, wherein said hinge comprises two hinge elements defining the geometric axis and being arranged one on each side of the connecting strip.

17. Assembly according to claim 15, wherein said hinge comprises one of a film hinge, a hinge having an attached axle, and an element borne by one of first and second parts, the element being mounted so that the element can rotate inside a recess formed in an other of the first and second parts.

18. Assembly according to claim 15, wherein the sheet is made of a thermoplastic chosen from polyethylenes, polypropylenes, polyethylene terephthalates and thermoplastic elastomers.

19. Assembly according claim 15, wherein the first and second parts are rigid, at least in the vicinity of the geometric axis.

20. Assembly according to claim 15, wherein said first part comprises a receptacle capable of containing a product, said first part having a free edge which defines an opening in the receptacle and the second part forming a lid capable of sealing the opening.

21. Assembly according to claim 20, further comprising a clasp releasably locking the lid over the opening in the receptacle.

22. Assembly according to claim 21, wherein the assembly has a substantially flat shape and the receptacle defines at least one compartment for receiving a product in solid or pulverulent form.

23. Assembly according to claim 15, wherein the sheet covers a major part of at least one of the first and second parts, and exhibits one of a logo, a trademark, commercial information and technical information.

24. Assembly according to claim 15, wherein the sheet is a label having an adhesive over its entire surface with the exception of a part which corresponds to the connecting strip.

25. Assembly according to claim 15, wherein the sheet is made of one of a woven material and a non-woven material.

26. An assembly comprising:

a first part;

a second part;

hinge means for pivotally connecting the first part and the second part about a geometric axis lying in a closure plane; and a sheet adhesively bonded onto at least a portion of a surface of each of the first and second parts, said sheet comprising connecting strip means for elastically biasing the assembly toward one of a closed position and an opened position;

wherein said sheet is a film adhesively bonded to an outer surface of one of said first and second parts.

27. Assembly according to claim 26, wherein said first part comprises a receptacle capable of containing a product, said first part having a free edge which defines an opening in the receptacle and the second part forming a lid comprising means for sealing the opening.

28. Assembly according to claim 27, further comprising clasp means for releasably locking the lid over the opening in the receptacle.

29. Assembly according to claim 28, wherein the assembly has a substantially flat shape and the receptacle defines at least one compartment for receiving a product in solid or pulverulent form.

30. Assembly according to claim 26, wherein the sheet covers a major part of at least one of the first and second parts, and exhibits one of a logo, a trademark, commercial information and technical information.

31. Assembly according to claim 26, wherein the sheet is a label having an adhesive over its entire surface with the exception of a part which corresponds to the connecting strip.

32. Assembly according to claim 26, wherein the sheet is made of one of a woven material and a non-woven material.

33. Assembly according to claim 15, wherein the connecting strip has two parts separated by the hinge.

34. An assembly according to claim 1, wherein said film provides an information surface.

35. An assembly according to claim 34, wherein said film covers substantially said one of said first and second parts.

36. An assembly according to claim 35, wherein said film covers said first and second parts.

37. An assembly according to claim 15, wherein said film provides an information surface.

38. An assembly according to claim 37, wherein said film covers substantially said one of said first and second parts.

39. An assembly according to claim 38, wherein said film covers said first and second parts.

40. An assembly according to claim 26, wherein said film provides an information surface.

41. An assembly according to claim 40, wherein said film covers substantially said one of said first and second parts.

42. An assembly according to claim 41, wherein said film covers said first and second parts.

* * * * *

UNITED STATES PATENT AND TRADEMARK OFFICE

CERTIFICATE OF CORRECTION

PATENT NO. : 6,474,493 B1
DATED : November 5, 2002
INVENTOR(S) : Frank Lacout

It is certified that error appears in the above-identified patent and that said Letters Patent is hereby corrected as shown below:

Column 7,
Line 51, insert -- to -- between “according” and “claim”.

Signed and Sealed this

Twenty-fifth Day of March, 2003

JAMES E. ROGAN
*Director of the United States Patent and Trademark Office*